US011383743B2

(12) United States Patent
Conyngham

(10) Patent No.: US 11,383,743 B2
(45) Date of Patent: Jul. 12, 2022

(54) RAIL SIGNAL ARRANGEMENT FOR A RAIL SIGNALING SYSTEM

(71) Applicant: UNIPART RAIL LIMITED, Oxford (GB)

(72) Inventor: Kurt Conyngham, Southport (GB)

(73) Assignee: Unipart Rail Limited, Oxford (GB)

( * ) Notice: Subject to any disclaimer, the term of this patent is extended or adjusted under 35 U.S.C. 154(b) by 643 days.

(21) Appl. No.: 16/131,434

(22) Filed: Sep. 14, 2018

(65) Prior Publication Data

US 2019/0077428 A1 Mar. 14, 2019

(30) Foreign Application Priority Data

Sep. 14, 2017 (GB) ..... 1714832

(51) Int. Cl.

| | |
|---|---|
| ***B61L 7/10*** | (2006.01) |
| ***B61L 5/18*** | (2006.01) |
| ***B61L 27/53*** | (2022.01) |
| ***H05B 45/58*** | (2020.01) |

(52) U.S. Cl.

CPC *B61L 7/10* (2013.01); *B61L 5/18* (2013.01); *B61L 5/1809* (2013.01); *B61L 5/1881* (2013.01); *B61L 27/53* (2022.01); *H05B 45/58* (2020.01); *B61L 2207/02* (2013.01)

(58) Field of Classification Search

CPC .. B61L 7/10; B61L 5/18; B61L 5/1809; B61L 5/1881; B61L 27/0088; B61L 2207/02; H05B 45/46; H05B 45/50; H05B 45/54; H05B 45/58

See application file for complete search history.

(56) References Cited

U.S. PATENT DOCUMENTS 6,448,716 B1 * 9/2002 Hutchison ..... H05B 45/00 315/129

6,570,505 B1 5/2003 Malenfant (Continued)

FOREIGN PATENT DOCUMENTS

DE 10121380 A1 12/2002

JP 2000172986 A 6/2000

(Continued)

OTHER PUBLICATIONS

Combined Search and Examination Report dated Feb. 27, 2018 in British Application No. 1714832.1.

*Primary Examiner* — Zachary L Kuhfuss

(74) *Attorney, Agent, or Firm* — Berg Hill Greenleaf Ruscitti LLP

(57) ABSTRACT

A rail signal arrangement for a rail signaling system comprises a rail signal having a rail signal lamp including a plurality of light emitter sub-arrays each comprising a light emitter, wherein the light emitter sub-arrays are electrically connected in parallel. A control circuit is provided and configured to operate the rail signal lamp in response to operating instructions from a remote operations management system, detect the proportion of light emitter sub-arrays that are in an operable condition with a monitoring system, and provide a condition status signal to the remote operations management system in accordance with whether the proportion of light emitter sub-arrays in an operable condition meets a minimum threshold level.

14 Claims, 2 Drawing Sheets

(56) References Cited

U.S. PATENT DOCUMENTS

| | | | | |
|---|---|---|---|---|
| 8,111,388 | B2 * | 2/2012 | Glandt | G01J 1/18 356/218 |
| 8,487,545 | B2 * | 7/2013 | Bhagat | H05B 45/50 315/291 |
| 2005/0253689 | A1 * | 11/2005 | Mollet | B61L 27/0005 340/286.01 |
| 2006/0001547 | A1 * | 1/2006 | Davenport | B61L 5/1881 340/641 |
| 2009/0167186 | A1 * | 7/2009 | Ghanem | B61L 5/1881 315/77 |
| 2010/0258682 | A1 * | 10/2010 | Fries | B61L 5/1881 246/1 C |
| 2012/0293074 | A1 * | 11/2012 | Fries | B61L 5/189 315/130 |
| 2013/0099933 | A1 * | 4/2013 | Berg | B61L 5/1881 340/815.45 |
| 2016/0347336 | A1 * | 12/2016 | Pless | B61L 7/10 |

FOREIGN PATENT DOCUMENTS

| | | | |
|---|---|---|---|
| WO | 9849872 | A1 | 11/1998 |
| WO | 2008141384 | A1 | 11/2008 |
| WO | 2015073954 | A1 | 5/2015 |

* cited by examiner

RAIL SIGNAL ARRANGEMENT FOR A RAIL SIGNALING SYSTEM

CROSS REFERENCE TO RELATED APPLICATION

The present application claims priority to United Kingdom Patent Application No. 1714832.1, filed Sep. 14, 2017, which is incorporated herein by reference in its entirety.

FIELD OF THE INVENTION

The present invention relates to a rail signal control system and a method of controlling the rail signal system.

SUMMARY OF THE INVENTION

According to a first aspect of the invention, a rail signal arrangement is provided for a rail signaling system comprising: a rail signal having a rail signal lamp comprising a plurality of light emitter sub-arrays each comprising a light emitter, wherein the light emitter sub-arrays are electrically connected in parallel, and a control circuit, wherein the control circuit is configured to: operate the rail signal lamp in response to operating instructions from a remote operations management system, detect the proportion of light emitter sub-arrays that are in an operable condition with a monitoring system, and provide a condition status signal to the remote operations management system in accordance with whether the proportion of light emitter sub-arrays in an operable condition meets a minimum threshold level.

According to a second aspect, a rail signaling system is provided having a rail signal arrangement according to the first aspect.

According to a third aspect, a method of controlling a rail signal is provided comprising: operating a rail signal lamp with a control circuit in response to operating instructions from a remote operations management system, the rail signal lamp comprising a plurality of light emitter sub-arrays each comprising a light emitter, wherein the light emitter sub-arrays are electrically connected in parallel, detecting the proportion of light emitter sub-arrays that are in an operable condition with a monitoring system, and providing a condition status signal to the remote operations management system in accordance with whether the proportion of light emitter sub-arrays in an operable condition meets a minimum threshold level.

According to a further aspect, a rail signal arrangement is provided for a rail signaling system comprising: a rail signal having a plurality of rail signal lamps each comprising a plurality of light emitter sub-arrays that each comprise a light emitter, wherein the light emitter sub-arrays of each rail signal lamp are electrically connected in parallel, and a control circuit, wherein the control circuit is configured to: operate the rail signal lamp in response to operating instructions from a remote operations management system, detect the proportion of light emitter sub-arrays that are operable with a monitoring system in each rail signal lamp, and provide a condition status signal to the remote operations management system in accordance with whether the proportion of operable light emitter sub-arrays in each rail signal lamp meets a respective minimum threshold level, wherein a plurality of the rail signal lamps have different respective minimum threshold levels.

According to a further aspect, a method of controlling a rail signal is provided comprising: operating a rail signal having a plurality of rail signal lamps with a control circuit in response to operating instructions from a remote operations management system, each of the rail signal lamps comprising a plurality of light emitter sub-arrays that each comprise a light emitter, wherein the light emitter sub-arrays of each rail signal lamp are electrically connected in parallel, detecting the proportion of light emitter sub-arrays that are operable with a monitoring system in each rail signal lamp, and providing a condition status signal to the remote operations management system in accordance with whether the proportion of operable light emitter sub-arrays in each rail signal lamp meets a respective minimum threshold level, wherein a plurality of rail signal lamps have different respective minimum threshold levels.

Each light emitter sub-array may comprise a plurality of light emitters that are electrically connected in series. The light emitters may be light emitting diodes.

The monitoring system may comprise a light sensor configured to detect light emitted from one or more light emitter sub-arrays when the one or more light emitter sub-arrays are supplied with a drive signal. Each light emitter sub-array may be provided with a light sensor optically coupled to receive light from a light emitter in the respective light emitter sub-array.

The monitor system may be configured to detect the condition of the light emitter sub-arrays by detecting current flowing through the light emitter sub-arrays when supplied with a drive signal.

The control circuit may be configured to provide rail signal lamp proving functionality, i.e., to store a condition status of each rail signal lamp and to return the condition status in response to an enquiry signal from a remote operations managements system.

The or each minimum threshold level may be at least 75%. The or each minimum threshold level may be a fixed minimum threshold level. The rail signal may comprise a plurality of rail signal lamps having different respective minimum threshold levels.

The rail signal may comprise a rail signal lamp for emitting red light with a threshold level that is higher than a rail signal lamp threshold level for a further rail signal lamp for emitting a non-red light.

The control circuit may be provided within a housing of the rail signal.

The light emitters may be LEDs and the control circuit may comprise a dummy load for dissipating current to emulate the current through incandescent light emitters.

BRIEF DESCRIPTION OF THE DRAWINGS

Examples are further described hereinafter with reference to the accompanying drawings, in which.

DETAILED DESCRIPTION

Figure 1:
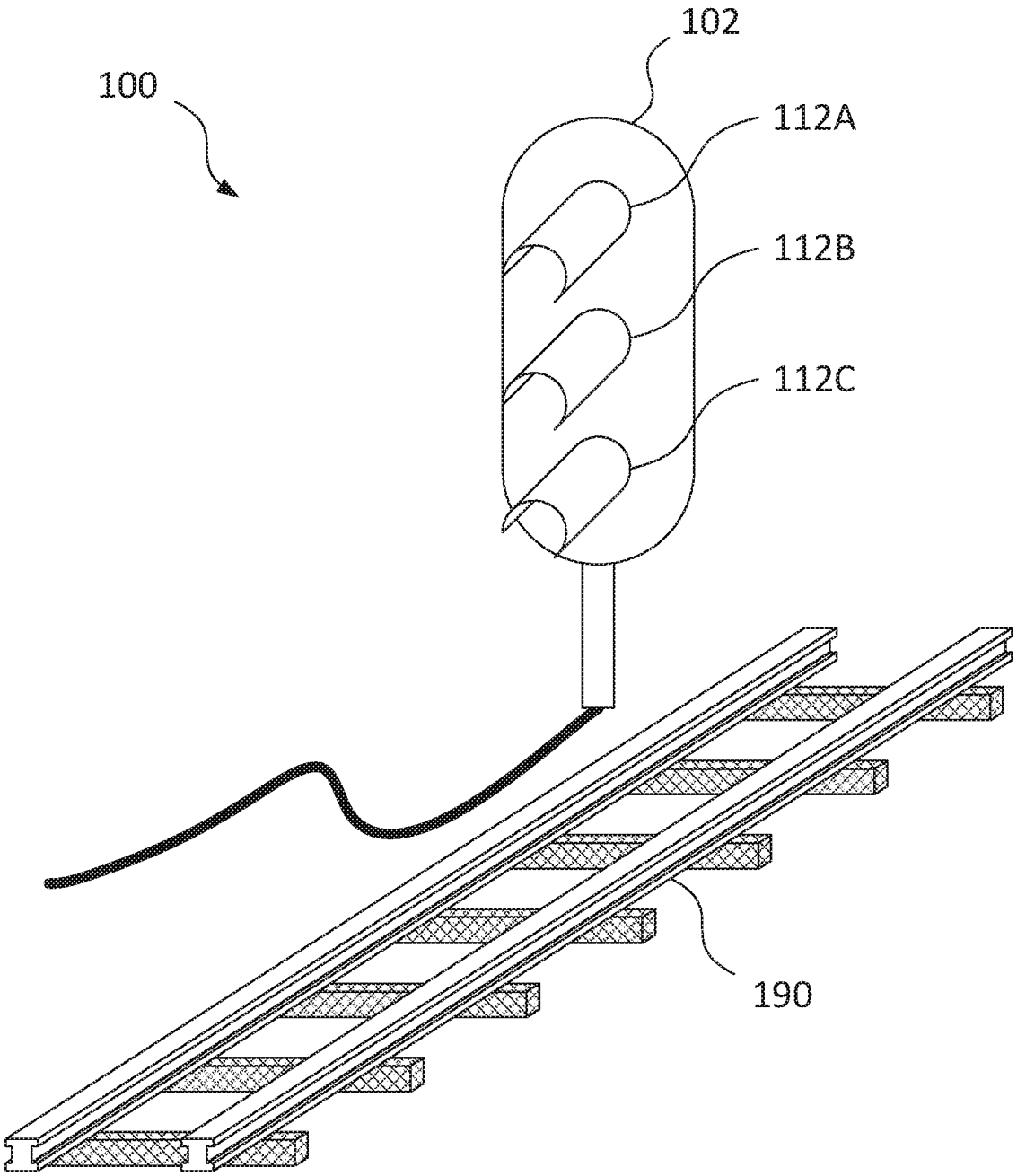
FIG. 1 illustrates part of a rail signaling system.

Like reference numerals refer to like elements throughout the drawings.

Figure 2:
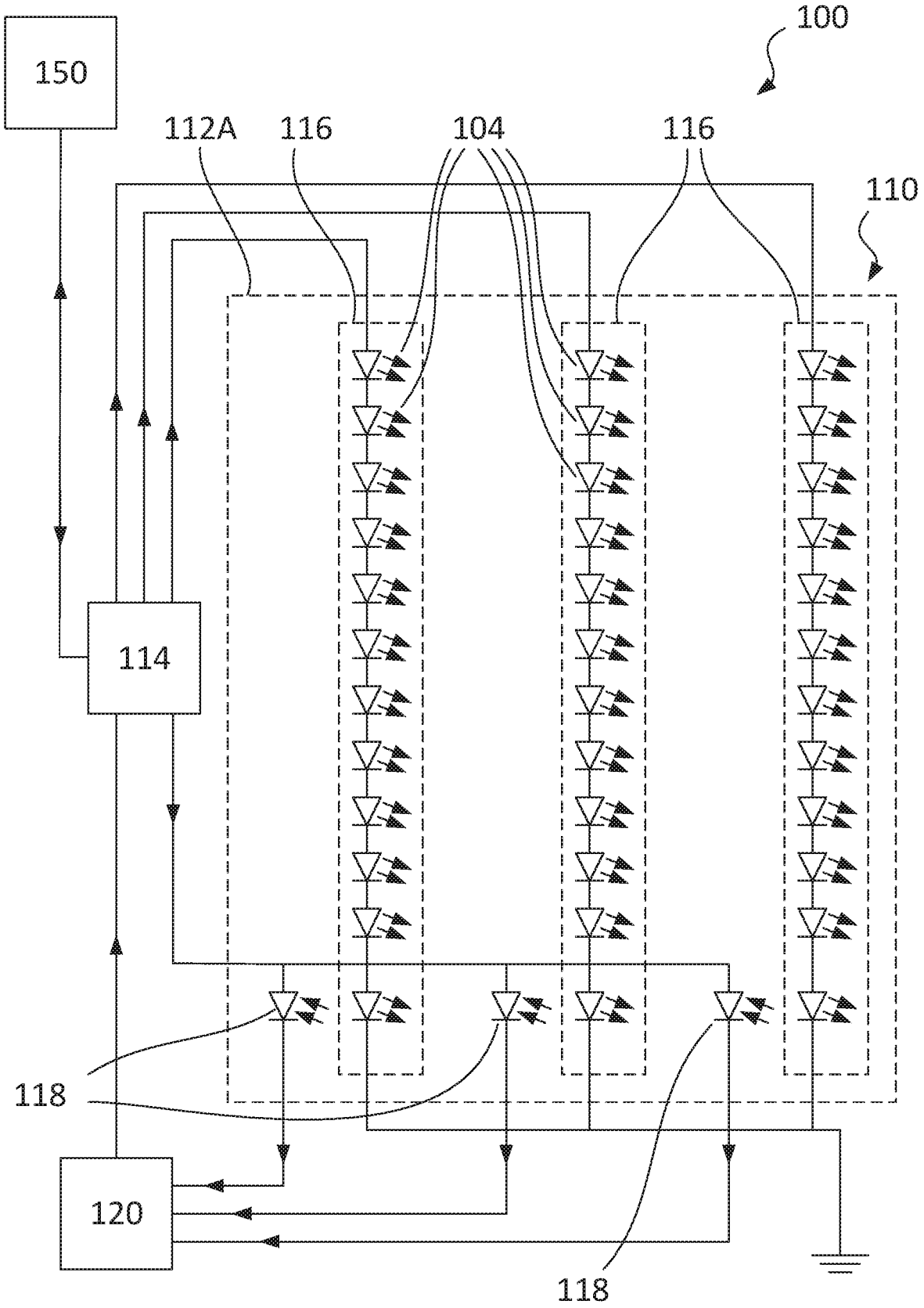
FIG. 2 schematically illustrates a part of a rail signaling system.

FIG. 1 illustrates part of a rail signaling system 100 having a rail signal 102 with an arrangement of one or more separate rail signal lamps 112A-112C for visually communicating with the drivers of trains travelling on a rail track 190. FIG. 2 schematically illustrates part of the rail signaling system 100 for controlling one of the rail signal lamps 112A.

The rail signal 102 has an arrangement of one or more signal lamps, and is also known within the rail industry as an "aspect". The illustrated rail signal 102 has three rail signal lamps 112A-112C for emitting red, yellow and green light respectively.

The rail signal 102 is controlled by a control circuit 110 that receives operating instructions from a remote operations management system 150, and the control circuit returns a binary condition status signal to the remote operations management system.

In the illustrated rail signaling system 100, the control circuit 110 is provided within the housing of the rail signal 102. Alternatively, the control circuit 110 may be provided separately and in electrical communication with the rail signal 102.

Power may be supplied to the control circuit 110 by the remote operations management system 150, along cabling with the operating instructions, or may be provided separately, e.g. supplied locally.

The control circuit 110 comprises the signal lamps 112A-112C, an aspect controller 114, and a monitoring system, discussed below.

Each of the rail signal lamps 112A-112C houses a plurality of light emitters 104, which are operated with a driving signal (e.g. an operating bias) supplied by the aspect controller 114. In the illustrated signal lamps 112A-112C, each of the light emitters 104 is a light emitting diode (LED). However, alternative light emitters may be used, e.g. incandescent lights.

The plurality of light emitters 104 in each rail signal lamp 112A-112C comprises a plurality of light emitter sub-arrays 116 that are electrically connected in parallel. In the illustrated signal lamps 112A-112C, each light emitter sub-array 116 is a string of light emitters 104 that are electrically connected in series.

Each signal lamp 112A-112C is provided with a monitoring system comprising a light sensor 118 that detects output from all or part of the signal lamp and a lamp health monitor 120 to determine how many of the light emitter sub-arrays 116 are emitting light. Although shown separately from the aspect controller 114 in FIG. 2, the lamp health monitor 120 may alternatively be a part of the aspect controller.

Each light emitter sub-array 116 may be provided with a respective light sensor (e.g. photodetector) 118 that is optically coupled to received light emitted by the light emitter sub-array. For example, in the illustrated signal lamps 112A-112C, each light emitter sub-array 116 is a string of serially connected LEDs 104, and each LED string is provided with a light sensor 118 that is optically coupled to receive light emitted by an LED in the respective LED string. Alternatively, a light sensor 118 may be provided that senses light emission from a light emitter 104 in each or a plurality of the sub-arrays 116. The or each light sensor 118 may be a photodetector, as shown in the illustrated signal lamps 112A-112C. Alternatively, the or each light sensor 118 may be a photosensitive transistor.

The lamp health monitor 120 receives a signal from the or each light sensor 118 and determines what proportion of the light emitter sub-arrays 116 in each rail signal lamp 112A-112C operate (e.g. emit light) when driven (e.g. powered with a drive signal) and/or what proportion of the light emitter sub-arrays do not operate when driven. If one light emitter 104 in a string of serially connected light emitters fails, then current will not pass through that light emitter string, and no corresponding light output will be received by the emission monitoring system 120, even if the light sensor(s) are optically coupled to receive light from a different light emitter of the string that has not failed. The lamp health monitor 120 provides a feedback signal to the aspect controller 114 corresponding to the proportion of light emitter sub-arrays 116 that operate when driven (e.g. in each rail signal lamp 112A, 112B, 112C).

The aspect controller 114 compares the feedback signal for the (or each) rail signal lamp 112A, 112B, 112C against a minimum threshold level (e.g. a level that is less than 100%) to produce a condition status signal (e.g. a binary signal). For example, the minimum threshold level may be that 75% of light emitter sub-arrays 116 in a rail signal lamp 112A, 112B, 112C of light emitter sub-arrays are operable (i.e. illuminate when driven by a drive signal). If the operation of the lamp 112A meets the satisfactory minimum threshold level, the aspect controller 114 returns a positive condition status signal to the remote operations management system 150. However, if the operation of the lamp 112A does not meet the satisfactory minimum threshold level, the aspect controller 114 returns a negative condition status signal (known as a "lamp out" signal) to the remote operations management system 150, informing the operator of the rail signaling system 100 that it is necessary for a service engineer to visit the rail signal 102 to replace or repair the respective rail signal lamp 112A, 112B, 112C (e.g. replace one or more light emitter sub-arrays 116).

Assessing the proportion of light emitter sub-arrays 116 that operate (e.g. illuminate when powered by a drive signal), when driven, against a minimum threshold level enables the rail signal lamps 112A-112C to provide an improved operational lifetime for the rail signal lamp, and enables the rail signaling system 100 to operate with increased operational efficiency. Where the emission intensity of a rail signal lamp 112A-112C is permitted to operate within a range, then following any reduction in the emission intensity of the rail signal lamp following the failure of a light emitter, assessing the reduced emission intensity against the minimum threshold level permits the continued use of the rail signal lamp, where it continues to fall within the permitted operating range. This avoids the transmission of a "lamp out" signal to the remote operations management system 150, and the unnecessary (or premature) cost and waste from the replacement of the corresponding rail signal lamp 112A-112C. In the case of a remotely located signal lamp 112A-1112C, the difficultly in accessing and replacing a rail signal lamp may be particularly significant.

The minimum threshold level for each rail signal lamp may be a fixed minimum threshold level that is pre-set in the rail signal (e.g. pre-set in the rail signal lamp) during manufacture. The fixed minimum threshold level may be pre-set in firmware of the aspect controller 114, or may be manually pre-set by a suitable configuration of an electromechanical input (e.g. during manufacture, selecting a resistance level of a variable resistor that is inaccessible to a subsequent user). The use of a fixed minimum threshold level enhances security by reducing the risk of an incorrectly set minimum threshold level. However, alternatively, the minimum threshold level may be settable by a respective level setting signal from the remote operations management system 150.

The minimum threshold level for each lamp 112A-112C may be the same. Alternatively, the rail signal lamps 112A-112C in each rail signal 102 may have different minimum threshold levels. For example, different minimum threshold levels may be appropriate for different lamp colours. For example, a range of permitted light emission intensities may be narrower for a lamp that emits red light than for a lamp that emits yellow or green, for the purposes of enhanced safety, and the minimum threshold level for red may accordingly be higher. Alternatively, it may be beneficial to apply different minimum threshold levels for different colours of emitted light in correspondence with the different human perceptions of differently coloured light. The use of different minimum threshold levels may further enhance operation lifetime for the rail signal and enable the rail signaling system 100 to operate with increased operational efficiency, in particular where failure of one or more light emitter sub-arrays 116 occurs in rail signal lamp 112A-112C with a lower minimum threshold level.

To provide backwards-compatibility, where the light emitters are light emitting diodes (which typically have a much lower drive current than an incandescent lamp providing a corresponding illumination) the driving currents to each rail signal lamp 112A-112C may be the same as for corresponding, legacy filament (incandescent) lamp systems, with excess current being dissipated through a dummy load (not shown).

The operation of a rail signaling system 100 has been described above in relation to assessing the illumination intensity of rail signal lamps 112A-112C in their on-states by detecting light emitted by a light emitter 104, with the lamp health monitor 120 receiving signals from light sensors 118 that detect emitted light. However, alternatively, the lamp health monitor may receive signals corresponding to current flowing through the sub-array, for example by detecting the voltage across a resistor serially connected with each sub-array, e.g. with a comparator circuit that provides an output to the lamp health monitor.

The rail signaling system 100 may additionally comprise proving functionality, in which the remote operations management system 150 sends repeated enquiry signals to the aspect controller 114 of the control circuit 110 in relation to each of the signal lamps 112A-112C, seeking return of the last stored condition status of each signal lamp. For hot-proving functionality, in which a signal lamp 112A-112C is in the on-state (being driven to emit light), the condition status determined when the lamp was last turned on will be returned, or alternatively a fresh determination of condition status may be prompted and the current condition status returned. For cold-proving functionality, in which a signal lamp 112A-112C is in the off-state (not being driven to emit light), the stored condition status will be the condition status that was determined by the lamp health monitor 120 when the last on-state (being driven to emit light) of the signal lamp was commenced, or the most recent condition status determination whilst the signal lamp was in the on-state.

The enquiry signals sent by the remote operations management system 150 may be short voltage pulses (positive or negative pulses) and the aspect controller 114 may present an electrical load corresponding to the condition status of a signal lamp 112A-112C (e.g. there may be a dedicated wire between the remote operations management system and the aspect controller for each signal lamp), and the remote operations management system may detect the condition status of a signal lamp by detecting the current flowing through the presented electrical load. Alternatively, the enquiry signals sent by the remote operations management system 150 may be digital codes that prompt the aspect controller 114 to return a further digital code corresponding to the last stored condition status of each signal lamp 112A-112C.

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. A rail signal arrangement for a rail signaling system comprising:

a rail signal having a plurality of rail signal lamps each comprising a plurality of light emitter sub-arrays that each comprise a light emitter, wherein the light emitter sub-arrays of each rail signal lamp are electrically connected in parallel;

an aspect controller having a control circuit configured to:

(i) operate the rail signal lamps in response to operating instructions from a remote operations management system, (ii) detect, with a monitoring system, a proportion of light emitter sub-arrays in each rail signal lamp that are operable to emit light when driven, and (iii) provide a condition status signal to the remote operations management system in accordance with whether the proportion of operable light emitter sub-arrays in each rail signal lamp meets a minimum threshold level;

wherein the control circuit is configured for at least two of the plurality of rail signal lamps to have different respective-minimum threshold levels; and wherein if operation of a rail signal lamp of said plurality of rail signal lamps meets the minimum threshold level, a positive condition status signal is sent to the remote operations management system, and wherein if operation of the rail signal lamp does not meet the satisfactory minimum threshold level, the aspect controller returns a lamp out signal to the remote operations management system thereby informing an operator of the rail signaling system that it is necessary to replace or repair the rail signal lamp; and wherein the positive condition status signal or the lamp out signal are sent for each of the at least two of the plurality of rail signal lamps having the different respective minimum threshold levels.

2. The rail signal arrangement of claim 1, wherein each light emitter sub-array comprises a plurality of light emitters that are electrically connected in series.

3. The rail signal arrangement of claim 1, wherein the light emitters are light emitting diodes.

4. The rail signal arrangement of claim 1, wherein each rail signal lamp comprises a light sensor configured to detect light emitted from more than one light emitter sub-array when the respective light emitter sub-arrays are supplied with a drive signal for generating light emission.

5. The rail signal arrangement of claim 1, wherein each light emitter sub-array comprises a light sensor configured to detect light emitted from the light emitter sub-array when the light emitter sub-array is supplied with a drive signal for generating light emission.

6. The rail signal arrangement of claim 1, wherein the monitoring system is configured to detect the condition of the light emitter sub-arrays by detecting current flowing through the light emitter sub-arrays when supplied with a drive signal for generating light emission.

7. The rail signal arrangement of claim 1, wherein the control circuit is configured to store a condition status of each rail signal lamp and to return the condition status in response to an enquiry signal from the remote operations management system.

8. The rail signal arrangement of claim 1, wherein the or each minimum threshold level is at least 75% of light emitter sub-arrays in a rail signal lamp are operable.

9. The rail signal arrangement of claim 1, wherein the or each minimum threshold level is a fixed minimum threshold level.

10. The rail signal arrangement of claim 1, wherein the rail signal comprises a rail signal lamp for emitting red light with a minimum threshold level that is higher than a rail signal lamp minimum threshold level for a further rail signal lamp for emitting a non-red light.

11. The rail signal arrangement of claim 1, wherein the control circuit is provided within a housing of the rail signal.

12. The rail signal arrangement of claim 1, wherein the light emitters are LEDs and the control circuit comprises a dummy load for dissipating current to emulate the current through incandescent light emitters.

13. A rail signaling system having a rail signal arrangement according to claim 1.

14. A method of controlling a rail signal comprising:

operating a rail signal having a plurality of rail signal lamps with a control circuit in response to operating instructions from a remote operations management system, each of the rail signal lamps comprising a plurality of light emitter sub-arrays that each comprise a light emitter, wherein the light emitter sub-arrays of each rail signal lamp are electrically connected in parallel, detecting, with a monitoring system, a proportion of light emitter sub-arrays in each rail signal lamp that are operable to emit light when driven, and providing a condition status signal to the remote operations management system in accordance with whether the proportion of operable light emitter sub-arrays in each rail signal lamp meets a minimum threshold level, wherein the control circuit is configured for at least two of the plurality of rail signal lamps to have different respective minimum threshold levels; and wherein if operation of a rail signal lamp of said plurality of rail signal lamps meets the corresponding minimum threshold level, a positive condition status signal is sent to the remote operations management system, and wherein if operation of the rail signal lamp does not meet the satisfactory corresponding minimum threshold level, the aspect controller returns a lamp out signal to the remote operations management system thereby informing an operator of the rail signaling system that it is necessary to replace or repair the rail signal lamp; and wherein the positive condition status signal or the lamp out signal are sent for the at least two of the plurality of rail signal lamps having the different respective minimum threshold levels.

* * * * *